United States Patent [19]

Ketteringham et al.

[11] 4,408,378

[45] Oct. 11, 1983

[54] APPARATUS FOR FORMING A FILAMENT COIL OF FIGURE OF EIGHT CONFORMATION

[75] Inventors: Terence A. Ketteringham, Middlesex; Dennis L. Lewis, Hertfordshire; David E. Mayley, London, all of England

[73] Assignee: Associated Electrical Industries Limited, London, England

[21] Appl. No.: 265,813

[22] Filed: May 21, 1981

[30] Foreign Application Priority Data

Nov. 21, 1980 [GB] United Kingdom ..... 8037420

[51] Int. Cl.³ ..... B65H 54/00

[52] U.S. Cl. ..... 28/289; 242/47

[58] Field of Search ..... 242/47; 28/289; 53/116, 53/430; 19/159 R

[56] References Cited

U.S. PATENT DOCUMENTS

| | | | |
|---|---|---|---|
| 2,468,834 | 5/1949 | Nash | 28/289 |
| 2,895,210 | 7/1959 | Hubbard | 53/429 |
| 2,971,244 | 2/1961 | Foller et al. | 53/116 |
| 3,167,895 | 2/1965 | Egler et al. | 53/430 X |
| 3,351,992 | 11/1967 | Carter | 53/429 |
| 3,375,988 | 4/1968 | Hude et al. | 28/289 X |
| 3,378,898 | 4/1968 | Mendes | 28/289 |
| 3,389,868 | 6/1968 | Majkrzak | 28/289 X |
| 3,423,807 | 1/1969 | Couturier et al. | 53/116 |

FOREIGN PATENT DOCUMENTS

| | | | |
|---|---|---|---|
| 1113166 | 8/1961 | Fed. Rep. of Germany | 28/289 |
| 2141740 | 3/1973 | Fed. Rep. of Germany | 28/289 |
| 3022088 | 12/1981 | Fed. Rep. of Germany | 28/289 |
| 2081764 | 2/1982 | United Kingdom | 242/47 |
| 385875 | 9/1973 | U.S.S.R. | 242/47 |

*Primary Examiner*—Robert Mackey

*Attorney, Agent, or Firm*—Kirschstein, Kirschstein, Ottinger & Cobrin

[57] ABSTRACT

A length of filament, such as wire or optical fiber, is loosely coiled on a flat carrier, in the form of a figure of eight coil, the lobes of which are laid respectively in clockwise and anticlockwise directions, by feeding the filament downwards through a gimbal mounted guide member attached to reciprocating means whereby the guide member is oscillated about two horizontal axes at right angles, corresponding to the transverse and longitudinal axes of the figure of eight coil produced. The guide member preferably incorporates a compressed air injection gun, to assist in maintaining the downward travel of the filament at a desired constant speed, the relationship between the filament travel speed and the oscillation frequencies being controlled to produce a figure of eight coil of a desired size.

7 Claims, 5 Drawing Figures

APPARATUS FOR FORMING A FILAMENT COIL OF FIGURE OF EIGHT CONFORMATION

Figure 1:
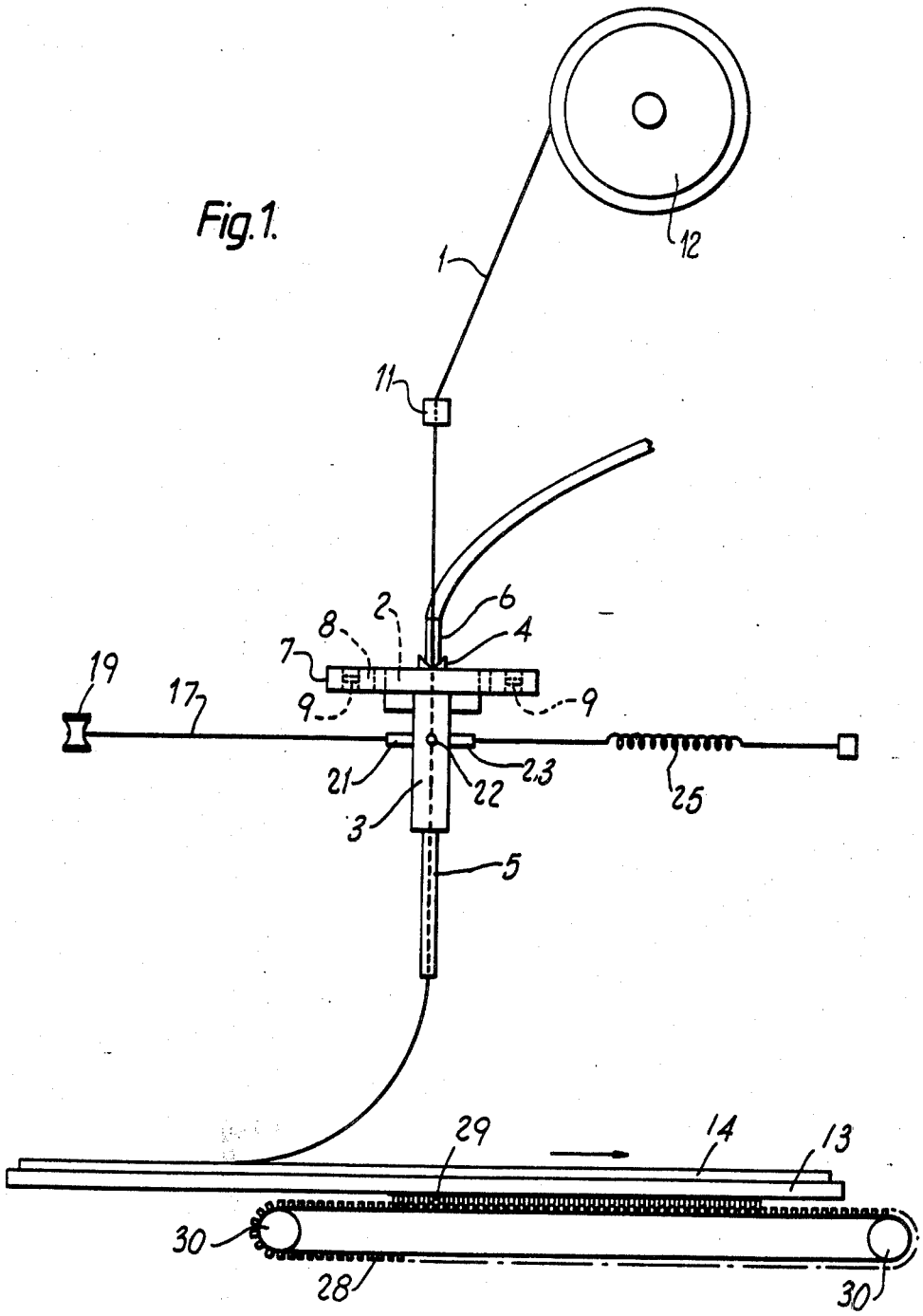

This invention relates to the packaging of one or more lengths of filamentary material, such as wire or optical fiber, in a form which is convenient for transportation and storage, and in which the filament can be maintained free from resultant twist.

The form of filament package with which the invention is concerned consists of one or more lengths of filament lying loosely coiled on a plane surface of a flat carrier and covered with a layer of padding material, the carrier being integral with or inserted into a shallow container in which the assembly of carrier, filament coil or coils and padding is enclosed, wherein the coil, or each coil, is composed of two lobes together forming substantially a figure of eight and consists of a multiplicity of turns, each of which is laid in said two lobes, the filament forming one lobe of each turn being laid in a clockwise direction, and the filament forming the other lobe of each turn being laid in an anticlockwise direction.

It is an object of the present invention to provide an improved process and apparatus for forming a figure of eight filament coil, in the manufacture of a filament package of the form described above.

According to the invention, a process for forming a filament coil of substantially figure of eight conformation consists in feeding a length of filament continuously downwards, at a controlled speed, on to the upper plane surface of a horizontally disposed carrier, through a gimbal mounted guide member while the said member is caused, by means of the gimbal mounting, to oscillate about two horizontal axes at right angles to one another, the relative frequencies and relative phases of the oscillations about the respective axes being so controlled that the downward path of travel of the filament between said guide member and the carrier describes a figure of eight whose longitudinal and transverse axes lie parallel to the respective axes of oscillation of the said member, the first filament path being caused, by said oscillations, to rotate alternately in a clockwise direction to describe one lobe of the figure of eight and in an anticlockwise direction to describe the other lobe of the figure of eight.

It is to be understood that the phrase "of substantially figure of eight conformation", as used herein with reference to the form of the filament coil, means that the conformation of the coil, and of each turn thereof, is not necessarily that of a true figure of eight, that is to say the lobes may not be circular but may be, for example, elongated in one direction, producing a distorted figure of eight, the degree of distortion depending upon the physical properties of the filament and upon the conditions employed for laying it down. However, the shape of the coil, and of the individual turns thereof, will hereinafter be referred to as "figure of eight" for brevity. The size, that is to say the area or periphery, of the turns of the coil is controlled by the speed of oscillation of the guide member in relation to the speed of downward travel of the filament: thus, either or both of these speeds can be adjusted to obtain a coil of a desired size, within limits dictated by the inertia and bending capability of the filament.

Preferably, during the deposition of the filament coil on the carrier by the method of the invention, the carrier is subjected to slow translatory or reciprocatory movement in the horizontal direction orthogonal to the longitudinal axis of the figure of eight coil, while the gimbal mounted guide member is maintained in a constant location. Such movement of the carrier results in relative displacement of the crossover points between the lobes of successive figure of eight turns of the coil, in the said horizontal direction. Such displacement of the crossover points prevents the buildup of an excessive thickness of the coil at the junction between the lobes, as compared with the thickness of the remainder of the lobes, and also causes some displacement of the lobes in successive turns of the coil, so that the lobes of the complete coil are of substantial width: this arrangement ensures stability of the coil structure, and prevents interlinking of the coil turns. Alternatively, if desired, other forms of motion, such as a circular, figure of eight, or more complex form, may be imparted to the carrier.

It will be apparent that a figure of eight coil formed by the method described above will not have any resultant twist induced in it by the coiling process, since although, in forming each turn of the coil, nearly one full axial twist will be induced in each lobe of the figure of eight, these twists will cancel out as a result of the opposed directions of coiling of the two lobes. Hence, when the filament is withdrawn from the package by pulling so as to unwind the coil, all the induced twist will be removed so that after withdrawal the filament will possess only the degree of twist, if any, that was present in it before being packaged.

A preferred form of apparatus for forming a figure of eight filament coil, by the process of the invention, includes a filament guide member consisting of a plate horizontally disposed above a flat filament receiving carrier and mounted on a vertical shaft, with a central channel through the plate and shaft for the passage of the filament downwards therethrough, a gimbal mounting arrangement for said guide member consisting of a fixed horizontally disposed outer ring and an inner ring pivoted on the outer ring for rotation about a first horizontal axis, the guide member plate being pivoted on the said inner ring for rotation about a second horizontal axis at right angles to the first horizontal axis, two sets of reciprocating means connected to the guide member shaft for imparting to the guide member oscillatory motion about the first and second horizontal axes respectively, means for controlling the relative rates of reciprocation of the said reciprocating means, to produce the required relative frequencies and relative phases of the oscillations of the guide member about the respective horizontal axes, means for guiding the filament path vertically downwards, from a source at a level above that of the said guide member plate and gimbal mounting arrangement, into the said channel through the guide member, and means for controlling the speed of downward travel of the filament from said source to the carrier.

This said means for controlling the speed of downward travel of the filament preferably includes means for applying impulsion to the downwardly travelling filament as it passes through the channel in the guide member, provided to ensure that the filament passes freely through the channel at the desired speed. Such impulsion is conveniently achieved by means of an arrangement for injecting compressed gas (suitably air) into the guide member channel, from an inlet pipe inserted through the guide member plate, the said arrangement preferably including a venturi structure incorporated within the guide member shaft.

The filament may be delivered to the guide member from any convenient source, for example from a rotating drum or reel, or directly from a filament manufacturing line, through suitably positioned means for guiding the travel path of the filament into a vertically downward direction. If desired, the filament may be passed around a motor-driven capstan to facilitate the control of its speed of travel, before passing through such guide means.

Figure 2:
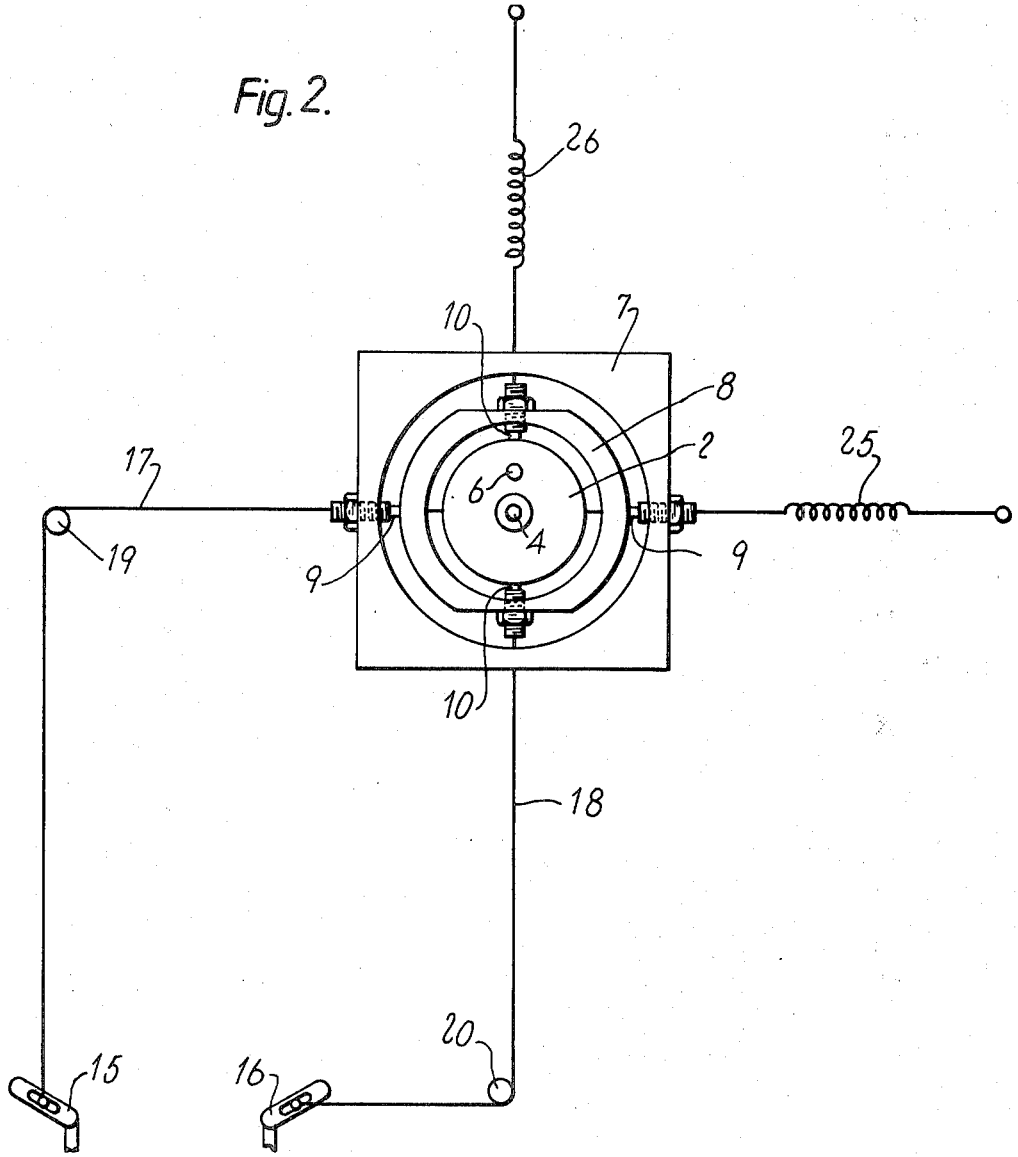
Figure 3:
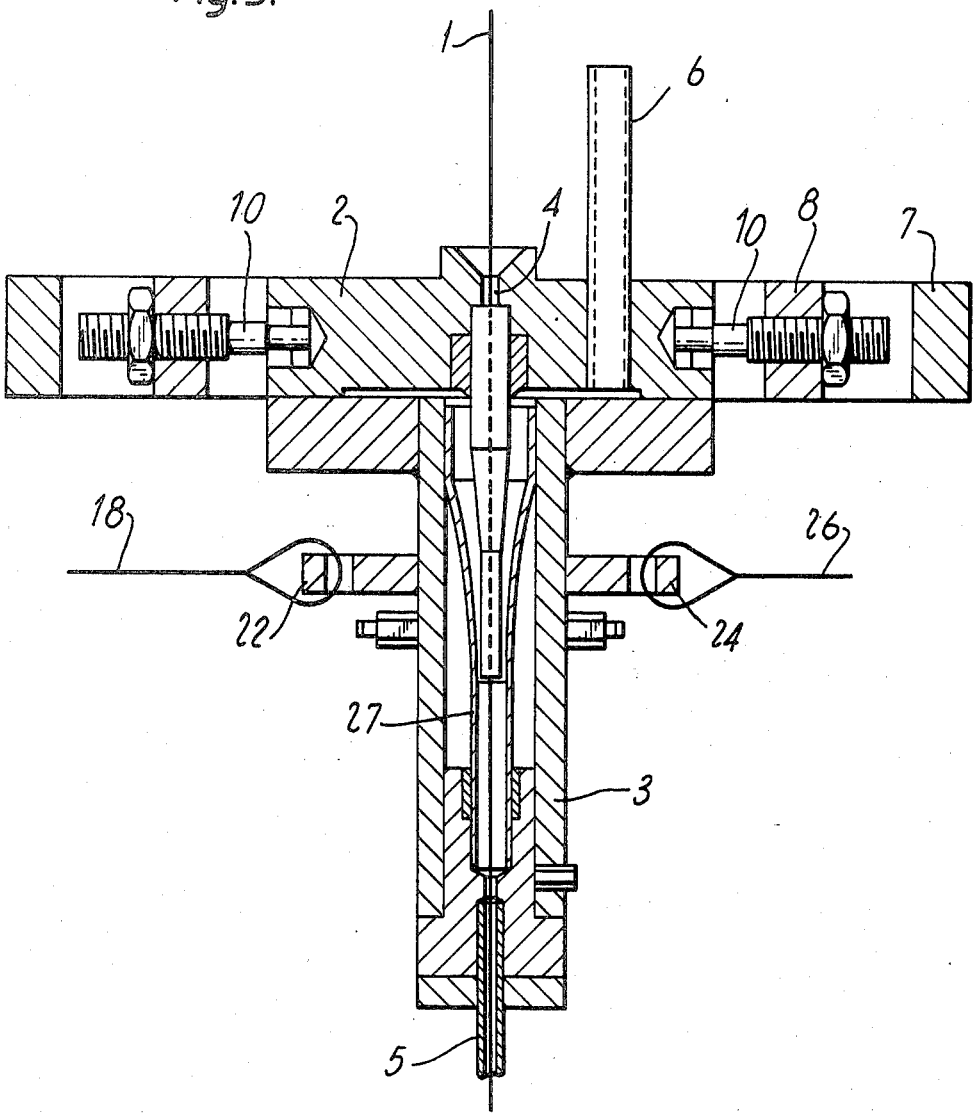
Figure 4:
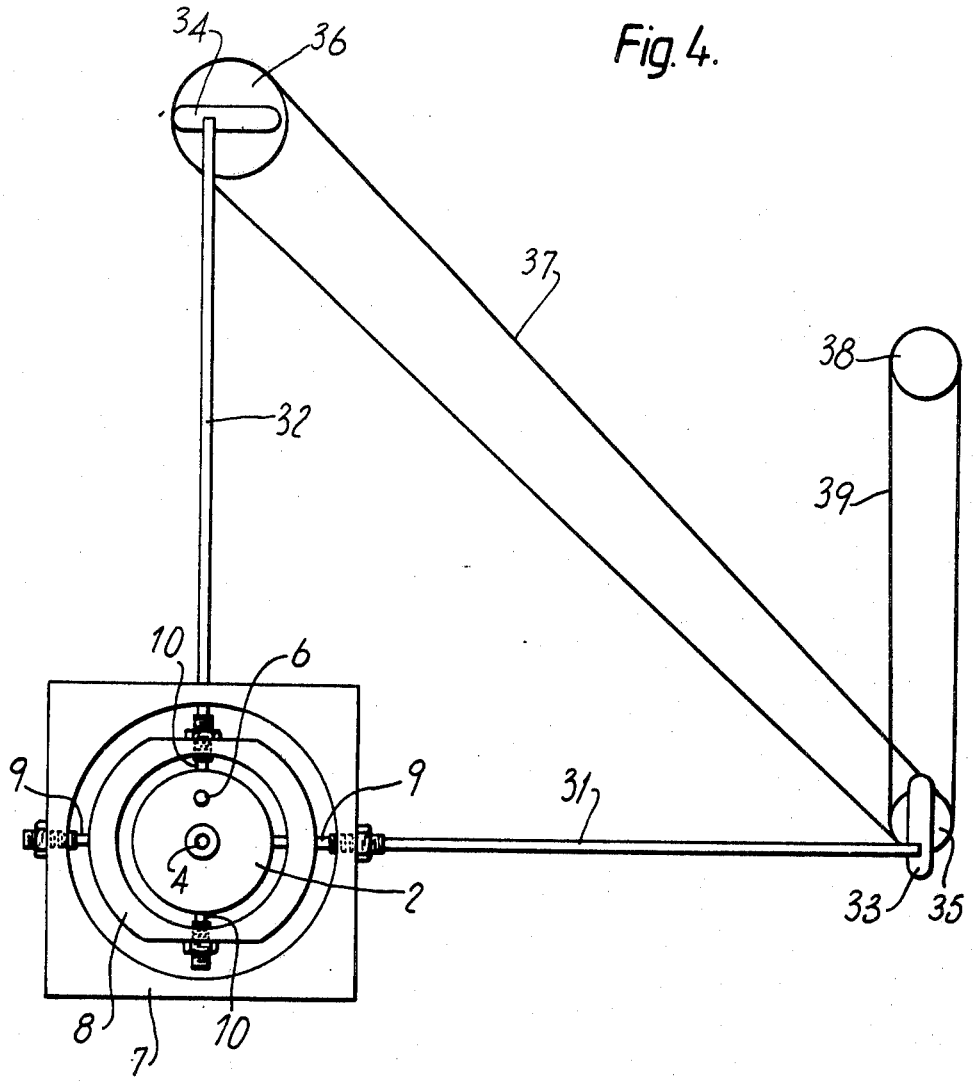
Figure 5:
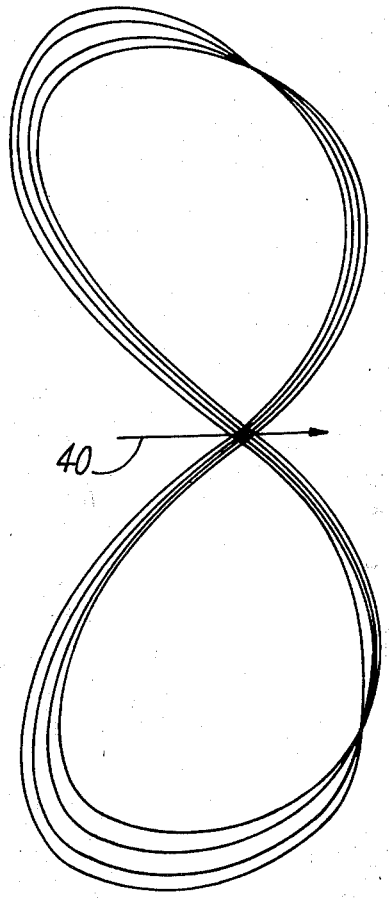

Some specific forms of apparatus employed for forming a figure of eight coil of optical fiber by the process of the invention, and the operation of the apparatus, will now be described by way of example with reference to the accompanying diagrammatic drawings, in which FIG. 1 shows one form of apparatus in elevation, FIG. 2 shows a plan view of the filament guiding arrangement and reciprocating means included in the apparatus of FIG. 1, FIG. 3 is a sectional elevation of the filament guide member of the apparatus of FIG. 1, and its gimbal mounting, showing the construction thereof in detail, FIG. 4 is a plan view of the filament guiding arrangement shown in FIG. 2 with an alternative form of reciprocating means, and FIG. 5 is a plan view of the form of the coil produced by means of the apparatus shown in FIGS. 1, 2, 3 and 4.

Like parts in the different figures of the drawings are indicated by the same reference numerals.

The apparatus shown in FIGS. 1 and 2 of the drawings includes a horizontally disposed gimbal mounted guide member comprising a metal disc 2 mounted on a shaft 3, with a central channel 4 for the passage of the optical fiber 1 therethrough, terminating in an elongated nozzle outlet 5 for the fiber, at the lower end of the shaft, and an inlet pipe 6 communicating with the channel 4, for the introduction of compressed air into the channel to impel the fiber through the channel at the desired speed. The gimbal mounting arrangement consists of a fixed outer ring 7, a floating inner ring 8 mounted on the outer ring by pivots 9, and pivots 10 by which the guide member disc 2 is mounted on the inner ring 8. This arrangement of pivots enables the guide member to be oscillated about two horizontal axes at right angles to one another.

As shown in FIG. 1, an eye 11 is located vertically above the opening of the channel 4 in the disc 2, for guiding the fiber, which is fed from a motor driven drum or capstan 12, into a vertical downward path before it passes through the guide member. The fiber is deposited upon a square tray or board 13, suitably of wood, which may be covered by a layer of plastic foam 14 (FIG. 1), or paper.

A reciprocating arrangement for effecting the oscillations of the guide member 2, 3, in such a manner that the optical fiber is desposited on the tray in a coil of figure of eight conformation, is shown in FIG. 2 and partly in FIG. 1 and consists of two rotatable crank arms 15, 16, driven by a motor through gearing (not shown) and respectively connected by means of cords or wires 17, 18, passing round guide rolls 19, 20, to projections 21, 22 carried by the guide shaft 3. The oscillations are further controlled by spring return means 25, 26 connected to projections 23, 24 on the shaft 3, diametrically opposite to projections 21 and 22, respectively (projection 23 is shown in FIG. 1 and projection 24 in FIG. 3), to provide back tension on the guide member. The operation of crank arm 15 and spring means 25 causes the disc 2 to oscillate about the pivots 10, controlling the transverse dimensions of the figure of eight coil formed by the deposited fiber, and the operation of crank arm 16 and spring means 26 causes the gimbal ring 8 and hence the disc 2 to oscillate about the pivots 9, controlling the longitudinal dimensions of the figure of eight coil. The crank arms 15 and 16 are driven through a gear ratio of 2:1 so that two complete transverse oscillations are effected by crank 15 in the same time that one complete longitudinal oscillation is effected by crank 16, the phase relationship between the oscillations being adjusted so that the minima of the transverse oscillations correspond alternately with the maxima and minima of the longitudinal oscillations. By this means, the downward path of travel of the fiber on to the tray is rotated around the two lobes of a figure of eight in clockwise and anticlockwise directions, respectively.

The sectional elevation of the guide member and gimbal mounting arrangement shown in FIG. 3 is drawn on a vertical plane containing the cord 18 and spring return 26 shown in FIG. 2, and shows details of the construction of the guide member, which incorporates an air injection gun. The compressed air inlet 6 communicates with a venturi structure 27 within the shaft 3, for effecting acceleration of the passage of the fiber through the channel 4 and nozzle 5.

Throughout the fiber deposition process, the tray 13 is slowly translated in the direction corresponding to the transverse axis of the figure of eight coil, as is indicated by the arrow in FIG. 1, to effect transverse displacement of successive turns of the coil.

A convenient arrangement for effecting the translation of the tray 13, for effecting relative displacement of the figure of eight coil turns desposited thereon, consists of a toothed belt 28 (FIG. 1) cooperating with a strip 29 of similar toothed belt material attached to the underside of the tray 13, the belt being rotated around rolls 30 driven by a slow speed motor (not shown). As the belt rotates, its teeth progressively interlock with those of the strip 29, thus causing the tray 13 to travel in a horizontal direction, as indicated by the arrow. If desired, the tray may be reciprocated by periodically reversing the direction of rotation of the belt.

The shape of the fiber coil produced by the apparatus shown in FIGS. 1, 2 and 3, operated in the manner described, is substantially as shown in FIG. 5, which includes four complete turns of the coil, overlapping one another as a result of the translation of the tray in the direction indicated by the arrow. Each of the crossover points 40 of the coil turns occurs vertically below the position of the outlet of the guide member nozzle 5 at the minima of both the transverse and longitudinal oscillations.

The optimum speed of operation of the apparatus, that is to say the optimum speed of the fiber feed and frequencies of the oscillations in relation thereto, will depend upon the physical characteristics of the fiber, in particular its mass per unit length, stiffness, and surface friction properties, all of which properties affect the inertia of the fiber, and hence the rapidity with which it can change its direction of angular momentum to effect the counter-directional coiling for producing a figure of eight coil of desired dimensions.

In a specific example of the operation of the apparatus described above with reference to FIGS. 1, 2 and 3, for coiling a silica optical fiber of 120 microns diameter with a protective coating of filled polyurethane resin 15 microns thick, the fiber is fed through the guide member at a rate of 50 meters per minute, and the crank arms 15 and 16 are rotated at speeds of 50 rpm and 25 rpm respectively, giving 50 complete transverse oscillations and 25 complete longitudinal oscillations of the fiber guide member per minute. These operating speeds result in the formation of a figure of eight coil in which the perimeter of each turn is approximately two meters, that is to say one meter in each lobe.

The alternative reciprocating means shown in FIG. 4 includes a pair of push-rods, 31 and 32, which are connected to projections carried by the guide member shaft in positions corresponding respectively to projections 23 and 24 (FIGS. 1 and 3). Thus the pushrod 31 replaces cord 17 and spring means 25 in FIG. 2, and push-rod 32 replaces cord 18 and spring means 26 in FIG. 2, the push-rods 31 and 32 respectively controlling the transverse and longitudinal dimensions of the figure of eight coil produced. The push-rods are driven by crank arms 33 and 34, which are respectively attached, for rotation, to rolls 35 and 36 connected together by a toothed belt 37. The system is driven by a stepper motor (not shown) via rolls 38 and belt 39. The relative frequencies of the transverse and longitudinal oscillations of the guide member are controlled by the relative magnitudes of the diameters of the rolls 35 and 36 to give the required 2:1 ratio of transverse to longitudinal oscillations, the diameter of roll 35 is half that of roll 36. If the system is operated to produce rotation speeds of 50 rpm and 25 rpm for rolls 35 and 36 respectively, with the same phase relationship as that indicated above with reference to FIGS. 1 and 2, and with the fiber being fed through the guide member at the rate of 50 meters per minute, the size of the coil formed will be the same as that described in the above specific example, the shape of the coil being substantially as shown in FIG. 5. The speed of rotation of the roll/belt system in relation to the rate of feed of the fiber may be suitably controlled by electronic means, which may be of known form and is not included in the drawings.

The particular phase relationship between the transverse and longitudinal oscillations referred to above is applicable to the coiling of the type of optical fiber described in the above specific example. However, it is to be understood that in some cases, depending on the physical characteristics of the filament, it will be desirable to employ a displaced phase relationship in order to avoid undue distortion of the figure of eight coil produced. For example, for coiling an optical fiber having high mass per unit length or having a soft coating such as a silicone resin, it may be desirable to advance the phase of the transverse oscillations by up to 45° in relation to the longitudinal oscillations.

The filament can readily be withdrawn from a package formed by the process of the invention and, for example, wound on to a drum, by placing the tray carrying the coil in such a position that the center of the figure of eight coil is vertically below a guiding eye similar to the eye 11 in FIG. 1, threading the free end of the filament through the eye and winding a turn or two around the drum, then rotating the drum, while the tray is kept stationary. The form of the coil ensures that the turns thereof remain in the correct sequence and cannot become interlinked and tangled during uncoiling.

We claim:

1. An apparatus for forming a filament coil of substantially figure of eight conformation, said apparatus comprising:

(A) a filament guide member consisting of a guide member plate mounted on a vertical shaft;

(B) means providing a central channel through said guide member plate and shaft for the passage of the filament downwards therethrough;

(C) a flat filament receiving carrier disposed below said guide member plate;

(D) said guide member plate being horizontally disposed;

(E) a gimbal mounting arrangement for said guide member, said gimbal mounting arrangement consisting of (i) a fixed horizontally disposed outer ring and (ii) an inner ring pivoted on the outer ring for rotation about a first horizontal axis, (iii) the said guide member plate being pivoted on the said inner ring for rotation about a second horizontal axis at right angles to the first horizontal axis;

(F) two sets of reciprocating means connected to the guide member shaft for imparting to the guide member oscillatory motion about the first and second horizontal axes, respectively, means for controlling the relative rates of reciprocation of the said reciprocating means, to produce the required relative frequencies and relative phases of oscillations of the guide member about the respective horizontal axes;

(G) means for guiding the filament path vertically downwards, from a source at a level above that of said guide member plate and gimbal mounting arrangement into the said channel through the guide member; and (H) means for controlling the speed of downward travel of the filament from said source to the carrier.

2. Apparatus according to claim 1, wherein each said said set of reciprocating means consists of a rotatable crank arm connected by a cord to a first projection carried by the guide member shaft, spring return means connected to a second projection carried by the guide member shaft in a location diametrically opposite to said first projection, and means for driving the two crank arms through a gear ratio such that the required relative frequencies of the oscillations of the guide member about the said horizontal axes are produced.

3. Apparatus according to claim 1, wherein each said set of reciprocating means consists of a push-rod connected at one end to a projection carried by the guide member shaft and at the other end to a crank arm, and a roll to which the said crank arm is attached for rotation, and wherein the said rolls of the respective sets of reciprocating means are connected together by a belt to form a rotatable system, the apparatus including means for driving the said system, and the relative diameters of the said rolls being such that on rotation of the said system the required relative frequencies of the oscillations of the guide member about the said horizontal axes are produced.

4. Apparatus according to claim 1, wherein the said means for controlling the speed of downward travel of the filament includes means for applying impulsion to the filament as it passes through the channel in the guide member.

5. Apparatus according to claim 4, wherein the said means for applying impulsion to the filament consists of an arrangement for injecting compressed gas into the guide member channel, from an inlet pipe inserted through the guide member plate.

6. Apparatus according to claim 5, wherein the said gas injection arrangement includes a venturi structure incorporated within the guide member shaft.

7. Apparatus according to claim 1, wherein the said means for controlling the speed of downward travel of the filament includes a motor-driven capstan around which the filament from said source is passed, said means for guiding the filament path vertically downwards being located between the capstan and the guide member plate.

* * * * *